United States Patent [19]

Flumignan et al.

[11] 4,431,884

[45] Feb. 14, 1984

[54] SNAP ACTION SWITCH

[75] Inventors: Dennis P. Flumignan, Sterling Heights; Ben J. Charboneau, Wixom; Gary B. Zulauf, Pinckney, all of Mich.

[73] Assignee: Gulf & Western Manufacturing Company, Southfield, Mich.

[21] Appl. No.: 406,183

[22] Filed: Aug. 9, 1982

[51] Int. Cl.[3] ..... H01H 21/40

[52] U.S. Cl. ..... 200/67 D; 200/293; 200/61.89; 200/67 A; 200/241; 200/67 B; 200/153 LA

[58] Field of Search ..... 200/67 B, 67 D, 67 DA, 200/67 DB, 67 E, 67 A, 241, 242, 153 L, 153 LA, 61.89, 293, 303, 335

[56] References Cited

U.S. PATENT DOCUMENTS

| | | | |
|---|---|---|---|
| 2,417,169 | 3/1947 | Kaminsky | 200/67 D |
| 2,486,061 | 10/1949 | Ransome | 200/67 D |
| 2,487,374 | 11/1949 | Riche et al. | 200/67 B |
| 2,533,671 | 6/1950 | Jacobs, Jr. | 200/67 R |
| 2,573,588 | 10/1951 | Miller | 200/67 D |
| 2,584,460 | 8/1952 | Jacobs, Jr. | 200/67 DA |
| 2,701,475 | 12/1955 | Readeker | 74/100 |
| 2,728,826 | 12/1955 | Cauder | 200/67 B |
| 2,840,656 | 10/1958 | Roeser | 200/67 DA |
| 3,098,905 | 7/1963 | Anderson | 200/241 X |
| 3,194,911 | 8/1965 | Sherwood | 200/67 D |
| 3,233,057 | 1/1966 | Aschwanden | 200/67 B |
| 3,291,930 | 12/1966 | Hipple | 200/67 D |
| 3,336,449 | 8/1967 | Ashman | 200/67 D |
| 3,412,225 | 11/1968 | Rogers et al. | 200/67 D |
| 3,571,541 | 3/1971 | Bedocs et al. | 200/67 A |
| 3,809,834 | 5/1974 | Hipple | 200/67 D |
| 3,872,417 | 7/1975 | Hufschmid | 200/67 DA |
| 3,958,091 | 4/1976 | Attridge | 200/67 D |
| 3,965,316 | 6/1976 | Olson | 200/67 D |
| 3,989,914 | 11/1976 | Stearley et al. | 200/67 D |
| 4,394,553 | 7/1983 | Feil | 200/67 DA |

FOREIGN PATENT DOCUMENTS

| | | | |
|---|---|---|---|
| 1515462 | 5/1969 | Fed. Rep. of Germany | 200/67 B |
| 2546423 | 11/1976 | Fed. Rep. of Germany | 200/67 DA |
| 963091 | 7/1964 | United Kingdom | 200/67 D |

OTHER PUBLICATIONS

Pictorial Handbook of Technical Devices, Grofstein and Schwarz, 1971, Chemical Publishing Co., Inc., New York, Chapter II, Sec. C, Paragraphs 1(b) & (d), pp. 252–253.

*Primary Examiner*—Stephen Marcus
*Assistant Examiner*—Ernest G. Cusick
*Attorney, Agent, or Firm*—Body, Vickers & Daniels

[57] ABSTRACT

A snap action toggle switch having a spring contact element formed of resilient metal strip material and including a U-shaped body member rigidified against flexure and comprised of a pair of spaced parallel side legs integral with and connected at one end by a flat base end portion and a plate spring member connected at one end with said base end portion and extending flatwise therefrom in the same general direction as the side legs and located therebetween. The spring contact element is supported for pivotal movement, in a plane including a pair of opposed stop surfaces at least one of which is a fixed contact, between a bracket arm terminal contact and an actuating lever arm portion which pivotally engage the other ends of respective ones of the body and plate spring members and longitudinally spring load the plate spring member in a longitudinally bowed shape effective to hold the spring contact element normally toggled to a stable rest position, with the base end portion thereof in pressure contact with one of the stop surfaces. The spring loaded plate spring member causes the spring contact element to snap over to an unstable position, with the base end portion thereof in pressure contact with the other one of the stop surfaces, on actuation of the actuator lever arm portion in a direction to move the one of the body and plate spring members engaged therewith to an over-center position relative to the other one of the members. On removal of the actuating force from the actuator lever arm portion, the spring contact element automatically snaps back to its stable rest position.

19 Claims, 15 Drawing Figures

2
30
24
22
20
46
48
34
38
32
44
S
40
52
B
2
A
26
12
10
14
C

FIG. 3
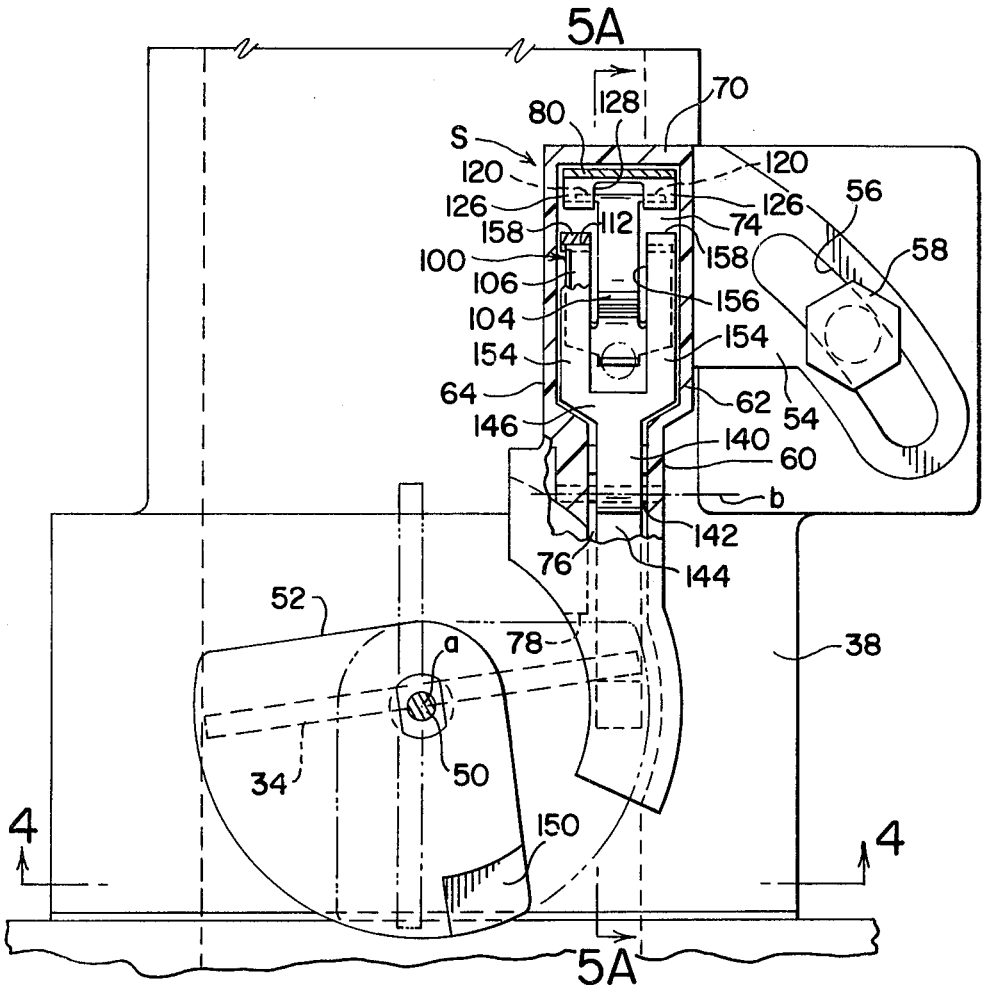
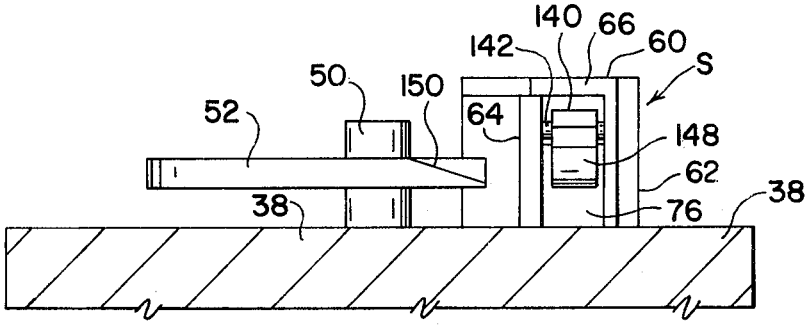
FIG. 4

SNAP ACTION SWITCH

BACKGROUND OF THE INVENTION

This invention relates in general to electrical snap action switches of the type employing a spring contact element adapted for snap action movement between two alternative switch positions engaged with or disengaged from a switch contact.

Snap action switches of heretofore known types generally have been adapted for actuation by an operating means moving in a direction normal to the switch body. Such type switches thus are entirely unsuitable for use in applications where the operating means for actuating the switch moves in a direction parallel to the switch body.

Many of such prior type snap action switches also employ flat switch blades having toed-in leg portions such as normally produce high stress areas in the switch blade. These stress areas are exposed directly to resistive heating, by the current passing through the stressed member when the switch is in its closed current-conducting position during usage, such as could shorten the switch life especially in high current applications. Because the stress in such switch blades with toed-in legs is more or less concentrated within a short portion of the length of the switch blade, the possibility of stress cracking of the switch blade, due to the notch sensitive beryllium-copper alloys customarily employed therefor, is thus always present in such type snap action switches.

Also, most if not all prior type snap action switches have only limited, if any at all, overtravel capability. Such switches, therefore, are unsuitable for use in applications requiring a relatively large overtravel capability.

SUMMARY OF THE INVENTION

The present invention contemplates a new and improved electrical snap action switch which overcomes all of the above referred to problems and others and provides a snap action switch of simple, economical, and easily assembled construction.

Briefly stated, in accordance with one aspect of the invention, a snap action switch is provided with a spring contact element of spring strip metal comprising a rigidified U-shaped body member and a flexurable plate spring member. The body member includes a pair of spaced parallel side leg portions extending from and connected at one end by a flat base end portion, and the plate spring member is likewise connected at one end to the base end portion and it extends therefrom in the same general direction as the leg portions and in a position centrally therebetween. Mounting means comprising a bracket arm terminal contact and an actuator arm portion of a switch actuator means support respective ones of the plate spring member and the rigid body member of the spring contact element, at the ends of the members opposite the base and portion of the body member, for pivotal movement of the spring contact element in a plane which includes a pair of opposed spaced stop surfaces between which the flat base end portion of the spring contact element extends flatwise. The plate spring member is held in a longitudinally bowed, flexed, spring-loaded position by the bracket arm terminal and actuator arm portion so that the force of the flexed plate spring thereby acts to hold the spring contact element in pivotally engaged relation with the bracket arm terminal and actuator arm portion, with the element pivotally held in a normal stable position with its flat base end portion in pressure contact with one of the stop surfaces. Actuation of the actuator arm portion to swing the one of the spring contact element members engaged therewith to an over-center position relative to the other one of the members then causes the spring contact element to snap over to an unstable shifted position with a contact on its flat base end portion in pressure contact with the other one of the stop surfaces which may comprise a fixed contact of the switch. On removal of the actuating force applied to the actuator means, the spring loaded plate spring member automatically causes the spring contact element to return to its normal stable position with a snap action, which is helpful in switching inductive loads. With this switch construction, the stress to which the spring member of the spring contact element is subjected is distributed more evenly along its length as compared to most prior snap action switch constructions, thereby reducing the possibility of stress cracking of the spring member due to the notch sensitive character of the beryllium-copper alloys customarily employed for the spring members of snap action switches.

In accordance with another aspect of the invention, the plate spring member in one form thereof is engaged and held in a longitudinally bowed compressed spring loaded position by the actuator arm portion to thereby effect the snap over of the spring contact element to its unstable shifted position with the base end portion thereof in pressure contact with the fixed contact. With this construction, the electrical current then passes directly through the rigid body portion of the spring contact element to the bracket arm terminal contact of the switch, rather than through the spring loaded plate spring member, and thus does not cause any resistive heating of the stressed plate spring member such as could shorten the life of the switch in high current applications.

In accordance with still another aspect of the invention, the rigid body member of the spring contact element in another form of the invention is engaged by the actuator arm portion to hold the plate spring member, which is of initially longitudinally bowed shape, in a tensioned spring loaded condition to thereby effect the snap over of the spring contact element to its unstable shifted position with the base end portion thereof in pressure contact with the fixed contact.

In accordance with a further aspect of the invention, the bracket arm terminal is flexurable a slight degree toward the stop surfaces, and the actuator arm portion of the actuator means is movable a further distance in the actuating direction following the snap over of the spring contact element to its unstable position, to thereby effect a longitudinal shifting of the element a short distance relative to and toward the stop surfaces so as to cause the base end portion of the spring contact element in pressure contact with the fixed contact to wipe thereacross, thereby assuring the formation of a good electrical contact therebetween.

In accordance with a still further aspect of the invention, the switch is provided with actuator means in the form of an elongated pivoted actuator lever extending generally longitudinally of the spring contact element and having a relatively large overtravel capacity such as required for certain use applications.

The principal object of the invention is to provide a snap action switch of simple and easily fabricated construction and of relatively inexpensive character.

Another object of the invention is to provide a snap action switch which is easily actuated by an elongated actuator member of the switch extending generally longitudinally of the spring contact element thereof and operable by operating means moving in a direction parallel to the switch body.

Still another object of the invention is to provide a snap action toggle switch capable of large amounts of overtravel of the actuating means therefor without loss of switch characteristics or stress failure of the spring member of the switch.

A further object of the invention is to provide a snap action switch which does not pass the electrical switch current directly through the stressed spring member of the switch.

A still further object of the invention is to provide a snap action switch wherein the possibility of stressinduced cracking of the stressed spring member thereof is greatly minimized.

Another object of the invention is to provide a snap action switch the actuated spring member of which returns to its inoperative rest position, on removal of the actuating force, with a snap action helpful in switching inductive loads.

Still another object of the invention is to provide a snap action switch providing relatively large switch point hysteresis.

Further objects and advantages of the invention will become apparent from the following detailed description of preferred species thereof taken in conjunction with the accompanying drawings.

BRIEF DESCRIPTION OF THE DRAWINGS

In the Drawings

FIG. 3 is an elevational view on an enlarged scale of the carburetor housing and associated snap action switch shown partly broken away in section;

FIG. 4 is a sectional view on the line 4—4 of FIG. 3;

DESCRIPTION OF THE PREFERRED EMBODIMENTS

Figure 1:
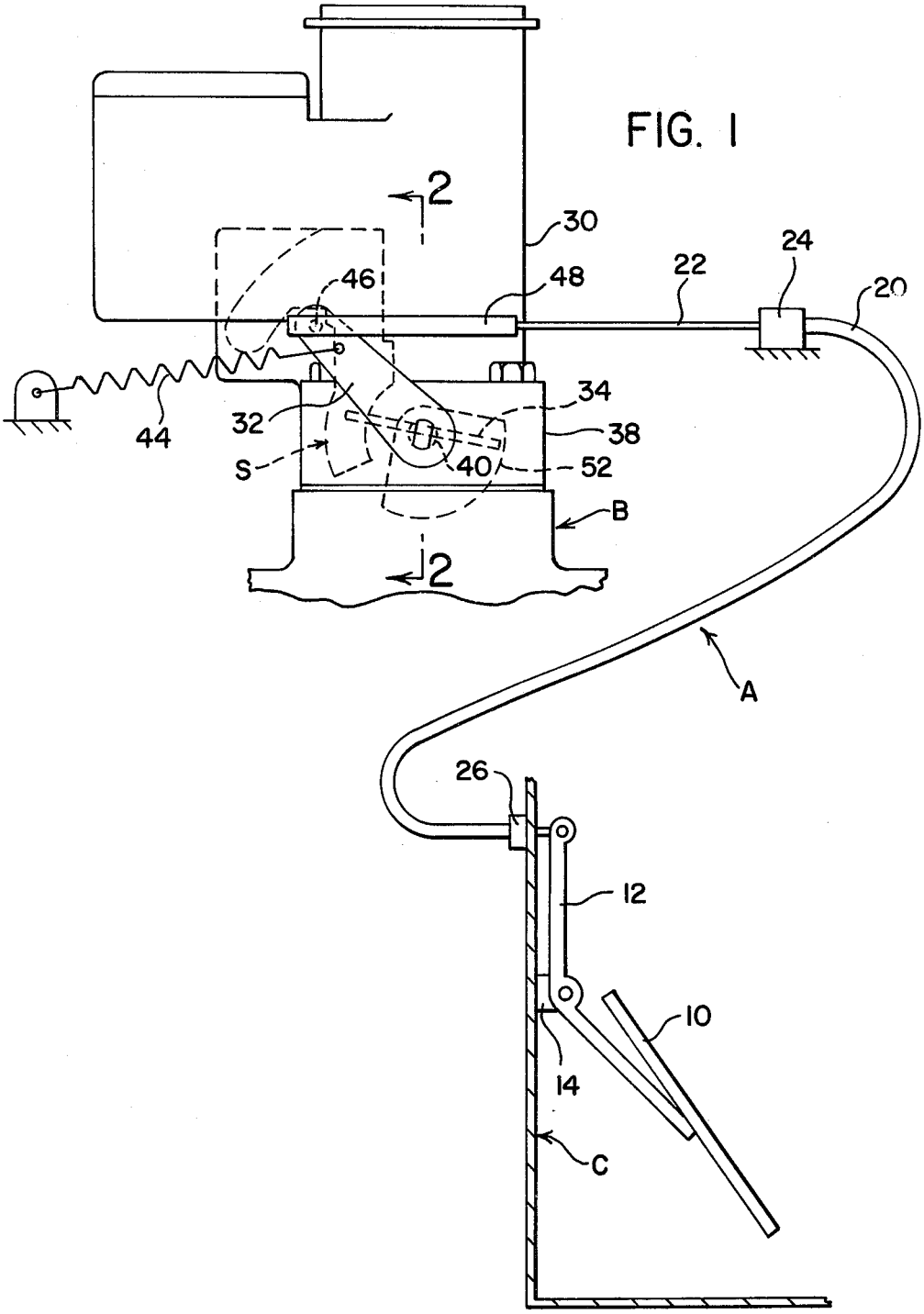
FIG. 1 is a schematic side elevational view showing an automotive carburetor control system of the type which may be provided with an electrical snap action switch comprising the invention to signal a given angular position of the carburetor butterfly valve.

Referring to the drawings wherein the showings are for the purpose of illustrating preferred embodiments of the invention only and not for the purpose of limiting same, FIG. 1 shows a system A for controlling the carburetor in an internal combustion engine having an intake manifold B. This system includes an accelerator pedal 10 pivotally mounted on a motor vehicle cowl C to manipulate a linkage 12 pivotally mounted on a trunnion 14. Bowden cable 20, having an internal flexible wire shaft 22, is supported between spaced couplings 24, 26 so that downward movement of pedal 10 draws wire shaft 22 to the right in FIG. 2 for the purpose of controlling the setting of carburetor 30. This carburetor, in accordance with standard practice, includes a link or lever 32 for the purpos of rotating internal butterfly or throttle valve 34 in the cylindrical passageway 36 (FIG. 2) of carburetor barrel and base end housing 38. Butterfly valve 34 is fixedly mounted on a shaft 40 journaled within carburetor housing 38 in accordance with standard practice and projecting at each end therefrom. Lever 32 is fixedly mounted on one of the projecting ends of shaft 40, i.e., end 42, and rotates this shaft and butterfly valve 34 when the lever is moved by wire shaft 22. A tension coil spring 44 holds lever 32 in the counterclockwise position, as viewed in FIG. 1, from which position lever 32 can be moved by wire shaft 22 through a universal coupling 46 and draw bar or link 48. As so far described, system A is a representative type of system in common use at present for controlling the angular rotated position of the butterfly valve 34 in the passageway 36 in response to movement of pedal 10.

The present invention relates to a snap action switch S for mounting on the carburetor 30 to energize an electrical circuit and create an electrical signal when the butterfly valve 34 reaches a predetermined angular rotated position in passageway 36 as it is rotated within the carburetor housing 38 by wire shaft 22 and the shaft 40 about the axis a thereof. Fixedly mounted on the projecting other end 50 of shaft 40 so as to rotate therewith is a face cam 52 which engages and operates the actuator means of the snap action switch S when butterfly valve 34 reaches the aforementioned predetermined angular rotated position. Although the snap action switch S is shown and described herein in connection with a carburetor control system A, it will be obvious that it can be employed as well for various other applications requiring such snap action switches adapted to be operated by an operating cam or other operating member moving in a direction parallel to the length of the main body 60 of the switch S and having a relatively large overtravel capability.

Referring now to FIGS. 2-7 in particular, the snap action switch assembly S according to the invention comprises switch body 60 in the form of an elongated housing which is provided with an external mounting bracket arm 54 (FIG. 3) having an arcuate slot 56 adapted to receive a fastening bolt 58 for securing the switch in place on the carburetor housing 38 in proper oriented position thereon relative to the operating cam 52 for the switch. The housing 60 is made of suitable electrically insulative material such as an indurated plastic material and formed in general with longitudinally extending spaced parallel side wall portions 62, 64 and spaced parallel top and bottom wall portions 66, 68 respectively, as viewed in FIG. 5A, and transversely extending end wall portion 70 and intermediate bridge wall portion 72 located more or less medially of the length of the switch body or housing 60. Walls 62–72 form a substantially fully enclosed chamber 74 at one end of the housing in which the main operating components of the switch are contained. Bottom wall 68 only extends between the end and intermediate transverse walls 70–72 of the housing so that the side and top walls 62–66 and medial bridge wall 72 together form a chamber 76 at the other end of the housing which is open at such other end as well as at the underside of the housing, as viewed in FIG. 5A, to receive the switch operating face cam 52. For this purpose also, the side wall 64 of housing 60 terminates some distance short of the aforementioned other end of the housing, as indicated at 78 in FIG. 3, to permit the entry of the operating cam 52 into the chamber 76 for the purpose of operating the switch S.

Mounted within chamber 74 of housing 60 adjacent the end wall 70 thereof is an electrically conductive bracket terminal switch contact 80 suitably fastened securely to the inner side of the housing top wall 66 as by an electrically conductive fastening rivet 82 and having an arm portion 84 extending transversely of the elongated housing 60 toward the opposite or bottom wall 68 thereof. Arm portion 84 preferably is formed with an offset free end 86 and is formed with a slight degree of flexibility in a direction lengthwise of the elongated housing 60. Also mounted within housing chamber 74 is a fixed switch contact 88 carried on the end of a rigid electrically conductive bracket member 90 suitably fastened securely to the inner side of the housing wall 66 as by an electrically conductive fastening rivet 92. Fixed contact 88 is located opposite and in spaced relation to a flat rest surface 94 formed on the inner side of the bottom wall 68 of the housing 60. Fixed contact 88 and rest surface 94 together form opposed spaced stop surfaces which are located in chamber 74 spaced longitudinally of the housing 60 a relative short distance from the offset end 86 of bracket arm terminal 80 and which are adapted to be alternately engaged by an elongated snap action spring contact element 100 in the respective snapover positions thereof. The fastening rivets 82, 92 are electrically connected, exteriorly of the housing chamber 74, and within a sub-housing portion **60*a* of main housing 60, to the electrically conductive core wires of respective circuit leads 96 and 98 by conductive metal clamps 96*a* and 98*a***.

In accordance with the embodiment of the invention shown in FIGS. 2–7, the elongated spring contact element 100 is formed as a stamping from a resilient metal strip material of suitable composition such as, for example, a beryllium-copper alloy or a phosphor bronze alloy, and having a strip thickness around 0.006 inch, for example. As shown more particularly in FIGS. 6 and 7, the spring contact element is comprised principally of an elongated, U-shaped flat body member or portion 102 and an elongated, longitudinally curved cantilever plate spring member or portion 104. The U-shaped body member 102 is comprised of a pair of spaced parallel leg portions 106 integral with and connected at one end by a flat base end portion 108. Leg portions 106 are provided with longitudinally extending stiffening ribs 110 to ridigify the body member 102 against flexure in a direction normal to the plane thereof. The leg portions 106 are formed at their free ends with knife edge ends 112 which extend transversely of the leg portions in aligned relation with each other to provide knife edge bearings for the body member 102 of the spring contact element 100. The connecting base end portion 108 of the U-shaped body member 102 is formed at its outward end with an upturned lip or flange 114 extending transversely of, and located centrally across the width of the body member, to provide a contact edge on the spring contact element for engagement with the fixed contact 88 of the switch.

The cantilever plate spring member 104 is connected at one end with the base end portion 108 of the body member 102 and extends flatwise therefrom in the same general direction as the leg portions 106 and located in a position centrally therebetween. The plate spring 104 is formed throughout most of its total length into a longitudinally bowed shape as indicaed at 116, curved to the same side of the plane of the body portion 102 of element 100 as the side thereof from which the contact lip 114 extends and in its free state or unloaded condition it extends in such bowed shape beyond the free ends 112 of leg portions 106 and to the other side of the plane of the body portion 102, with a short free end portion of the spring bent into a slightly reverse bowed shape as indicated at 118. The plate spring 104 thus is of a somewhat shallow mutilated S-shaped curved form. At its free end, the plate spring 104 is formed with laterally outward extending, mounting or retaining ears 120 the inward side edges 122 of which extend transversely of the spring element in aligned relation with one another. The inward side edges 122 of the ears 120 may be of rounded cross-sectioned form, if desired.

Figure 7:
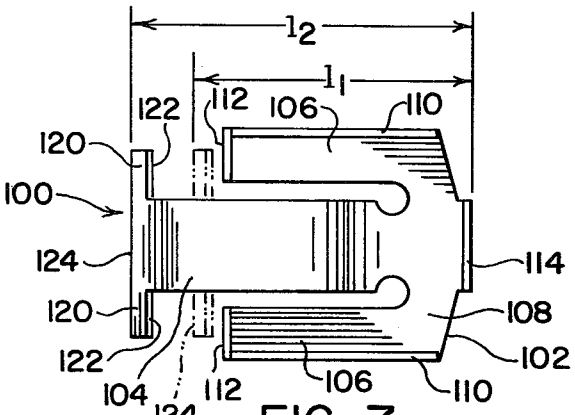
FIG. 7 is a plan view of the spring contact element shown in FIG. 6.
Figure 6:
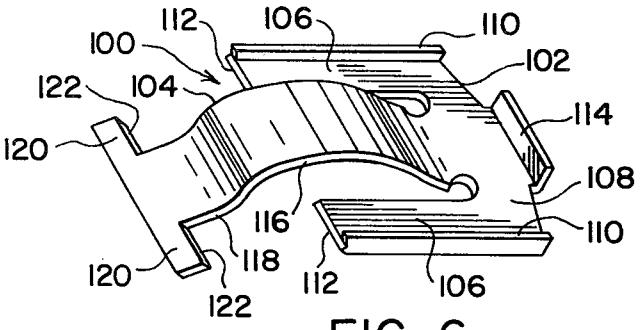
FIG. 6 is a perspective view of the spring contact element in the assembled spring-loaded condition thereof in the switch shown in FIGS. 2-4.

As shown in FIG. 7, the spring contact element 100, as fabricated, is formed with an overall free length $l_1$ as measured to the free edge 124 of the unstressed plate spring 104 and its retaining ears 120, as shown in dash-dot lines in FIG. 7. In assembling the spring contact element 100 into the switch S with the other components thereof, the bowed plate spring 104 is extended, and thereby longitudinally tensioned, to a substantially greater overall length $l_2$ as denoted by the solid line showing of the extended plate spring.

The elongated spring contact element 100 is mounted within the chamber 74 of switch housing 60 in a position extending generally longitudinally thereof, with the plate spring member 104 pivoted and supported at its free end on the bracket arm terminal 80 for pivotal movement of the element 100 in a plane normal to the plane of the body member 102 and which includes the stop surfaces 88 and 94, and with the element 100 extending from the support bracket 80 in a direction toward the stop surfaces 88, 94, with the flat body member 102 of the element 100 extending flatwise between the stop surfaces 88, 94 and its bent end contact 114 facing toward the fixed contact stop surface 88. As shown in FIGS. 3 and 5A–5C, the arm portion 84 of bracket arm terminal 80 is bifurcated to provide a pair of spaced arms 126 (FIG. 3) and a central slot 128 therebetween through which the free end of the plate spring member 104 extends with the lateral retaining ears 120 thereof caught behind the bracket arms 126 and held in shallow U-sectioned, laterally aligned trunnion bearing notches 130 formed therein.

The spring contact element 100 is actuated and also held in the aforementioned pivotally mounted position in the switch S, with the retaining ears 120 of plate spring member 104 held in continuous bearing engagement within the trunnion bearing notches 130 of bracket arm terminal 80, by actuating means comprising an elongated actuator lever 140 extending longitudinally within the switch housing 60 and pivoted intermediate its ends on a laterally extending pivot shaft 142 in housing chamber 76 for pivotal movement about an axis b normal to the plane of pivotal movement of spring contact element 100 on bracket arm terminal 80. Actuator lever 140 is comprised of a cam engaging lever arm 144 and a spring contact engaging lever arm 146 which extend in opposite directions lengthwise of housing 60 from pivot shaft 142. Lever arm 144 is located within chamber 76 of switch housing 60 and is provided at its free end with a rounded cam follower projection 148 adapted to be engaged by and ride on a tapered cam surface 150 of the face cam 52 when the latter is rotated to its switch actuating position as shown in dash-dot lines in FIG. 3, to thereby pivot the lever 140 in the direction as indicated by the arrows in FIGS. 5B and 5C to actuate the switch S. Lever arm 146 extends from the pivot shaft 142 into housing chamber 74 and abreast of or alongside spring contact element 100 through a relief space 152 above the bridge wall 72 of the housing, and it is bifurcated to provide a pair of parallel spaced actuator arms 154 with a central slot-like opening 156 therebetween, as shown in FIGS. 3 and 5A–5C. The bracket arm 90 which carries the fixed contact 88 extends through this slot-like opening 156 between the two spaced actuator arms 154 of the actuator lever 140. Actuator arms 154 are provided at their free ends with transverse actuator arm end portions 158 which are laterally aligned with, and extend across and engage the free knife-edge bearing ends 122 of the leg portions 106 of spring contact element 100. The arm end portions 158 are provided with laterally extending aligned V-shaped bearing notches or grooves 160 which receive and pivotally support therein the knife-edge bearing ends 112 of the leg portions 106 of spring contact element 100. The actuator arm end portions 158 of actuator lever 140 forcibly press against the knife edge bearings ends 112 of the leg portions 106 of spring contact element 100 to thereby exert a compressive force therein which then effects, through the connecting base end portion 108 of the element 100, a longitudinal tensioning and extensioning of the bowed plate spring member 104 to the extended length $l_2$ and thus into a longitudinally spring-loaded condition which then acts to continuously hold the spring contact element in its mounted position on the bracket arm terminal 80 and actuator lever 140.

Figure 2:
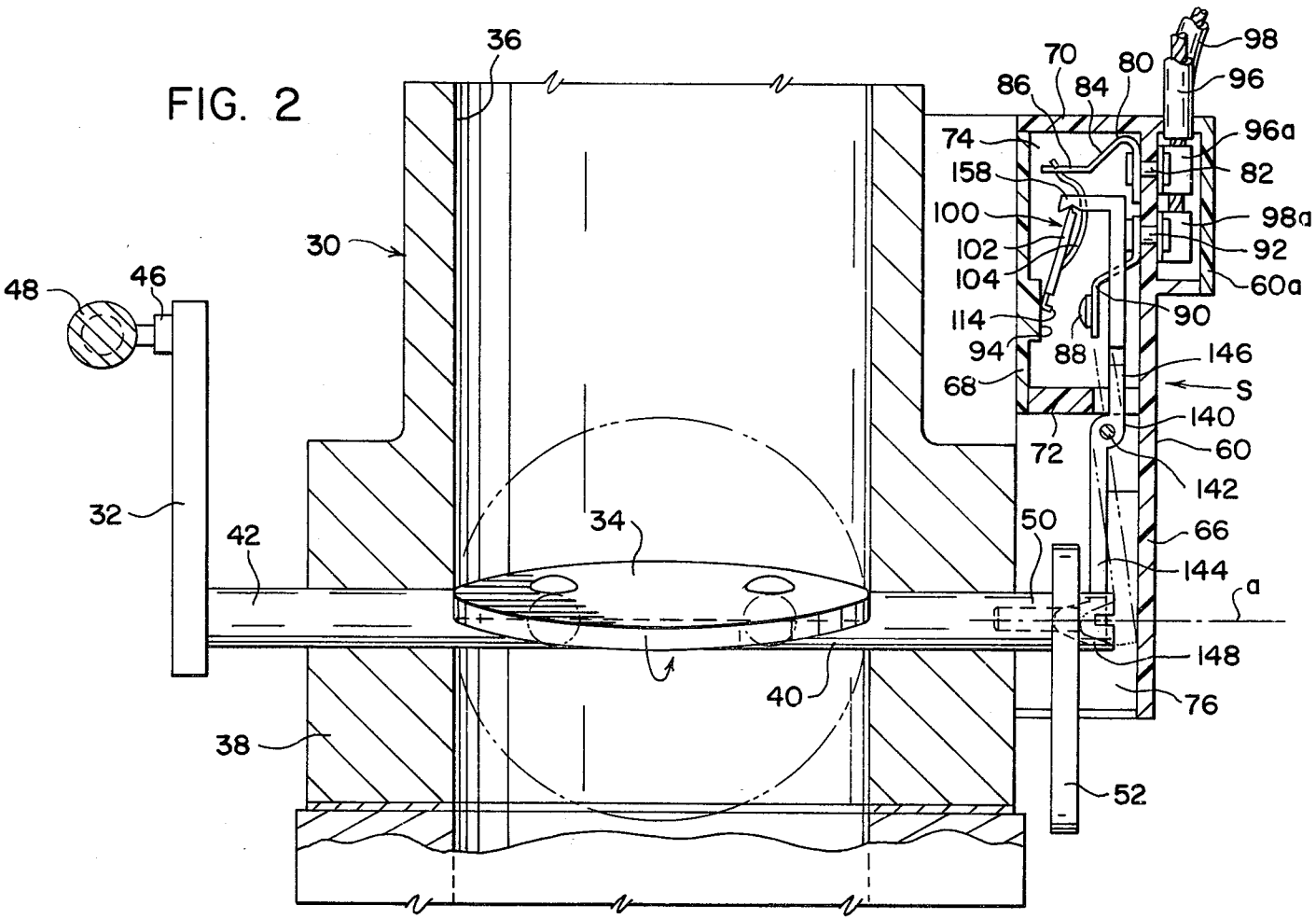
FIG. 2 is a vertical section on the line 2—2 of FIG. 1 showing in section and on an enlarged scale a snap action switch comprising the invention mounted on the carburetor housing.

For the spring contact element 100 to properly operate in its intended snap-action switching manner, it must be mounted on the bracket arm terminal 80 and actuator lever 140 in a position as shown such that the bowed and tensioned plate spring member 104 bows or curves away from the flat base end portion 108 of the body member 102 of the spring contact element 100 in a direction toward the lever arm 146 of the actuator lever 140. Also, in the normal assembled position of the spring contact element 100 in the switch S, as shown in FIGS. 2 and 5A, the arm end portions 158 of actuator lever 140 press against the ends 112 of the leg portions 106 of body member 102 to exert a force endwise thereagainst passing inside of and between the main bowed portion 116 of the plate spring member 104 and the straight overcenter or snap-over line L (FIG. 5A) of the element 100, which line L extends through and between the pivot axis of the plate spring member on bracket arm terminal 80 and the bearing plate 162 of the base end portion 108 of the body member 102 of spring contact element 100 against the rest or stop surface 94 when the element is in its normal rest or stable position shown in FIG. 5A. This force exerted by the actuator lever 140 endwise against the body member 102 of spring contact element 100 thus acts to hold and maintain this element in its normal rest or stable toggled position as described above and shown in FIG. 5A.

Figure 5B:
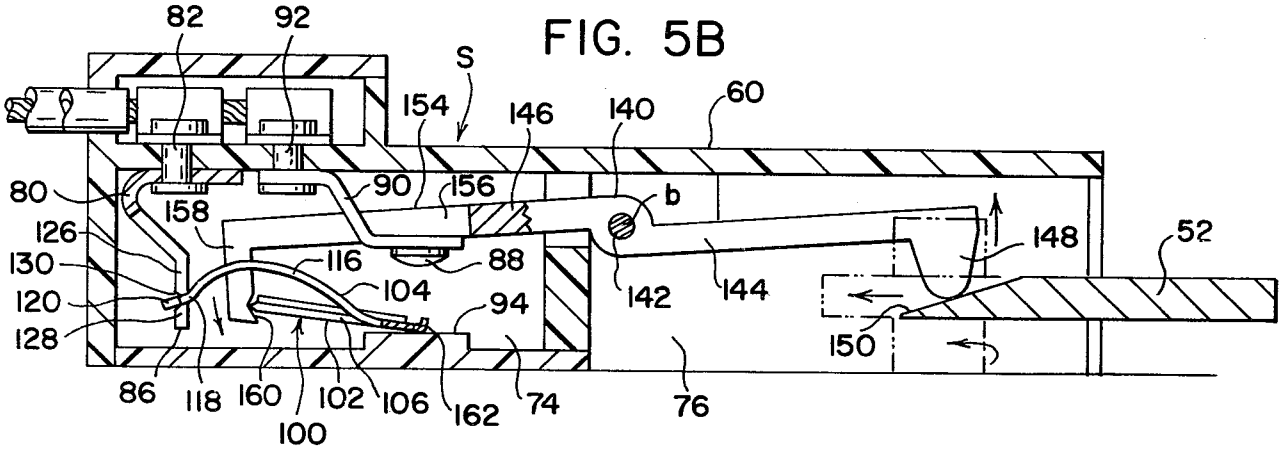
FIGS. 5A, 5B and 5C are longitudinal sectional views on an enlarged scale of the snap action switch comprising the invention taken on the line 5A—5A of FIG. 3 and respectively showing the spring contact element and actuator lever thereof in the stable rest position, intermediate shifted position, and unstable final shifted position of the spring contact element.
Figure 5A:
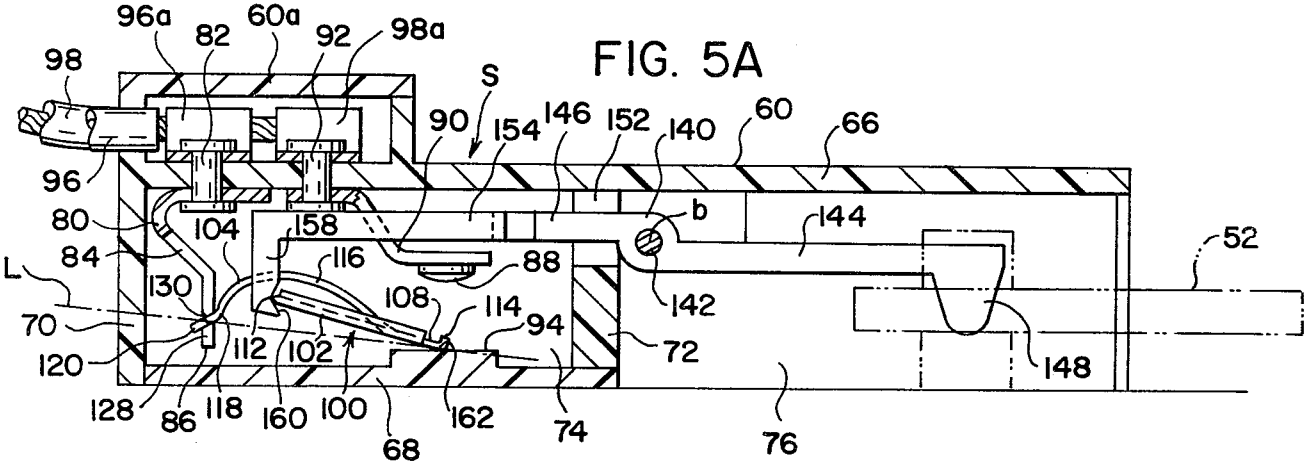
Figure 5C:
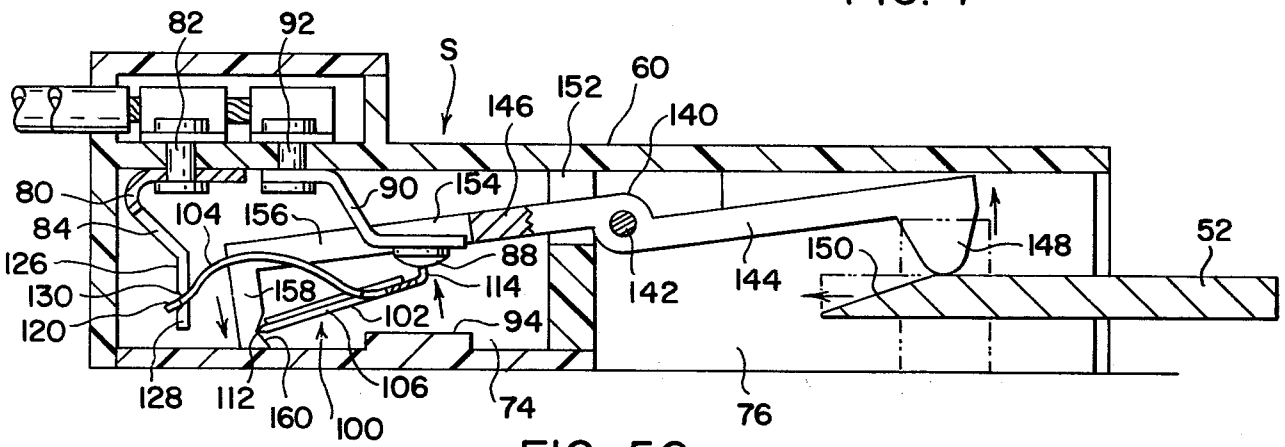
Figure 8:
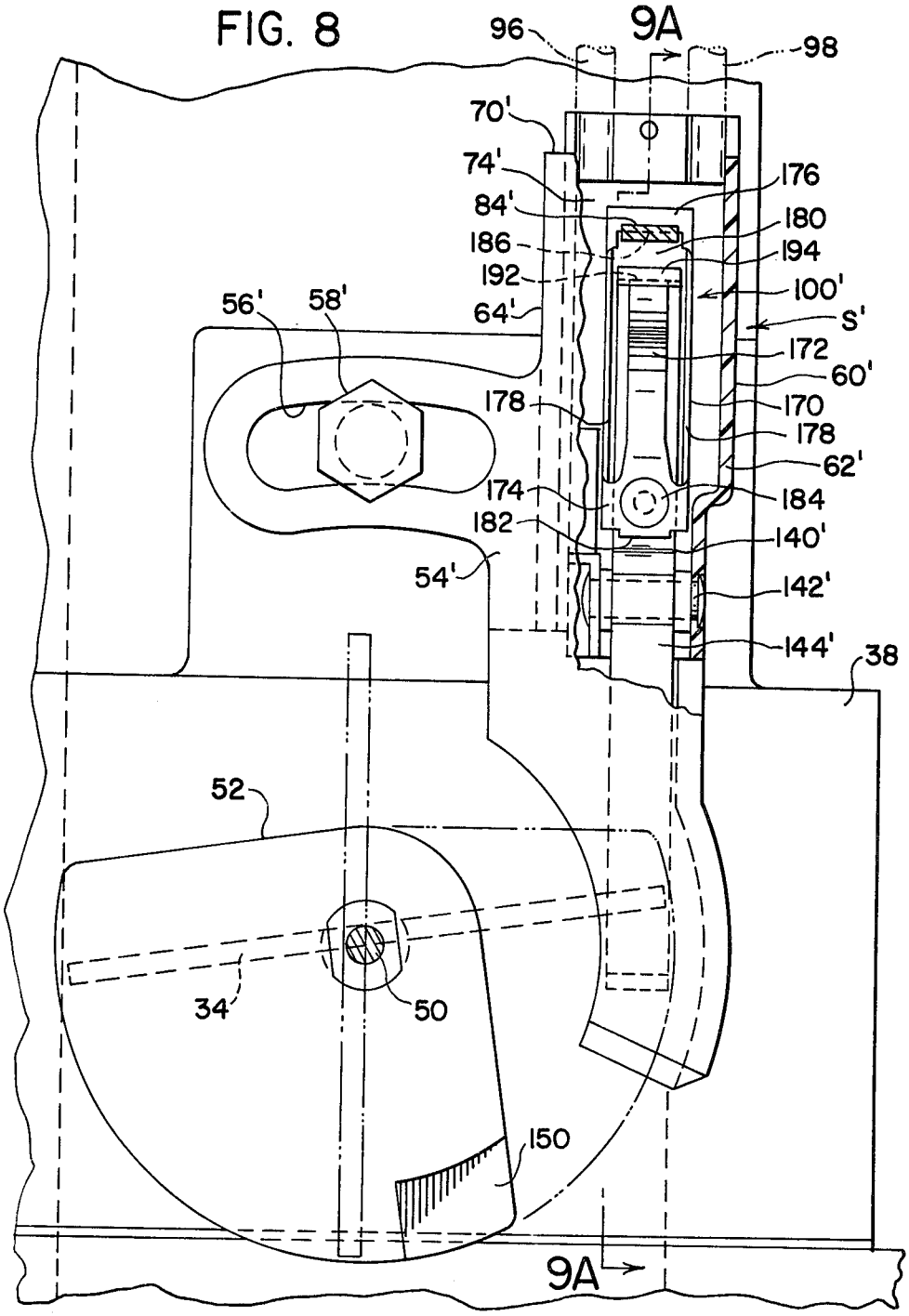
FIG. 8 is an elevational view similar to FIG. 3, and on an enlarged scale, showing a modified form of snap action switch comprising the invention.

When the actuator lever 140 is pivoted by the engagement of the tapered cam surface 150 of cam 52 with the cam follower projection 148 on lever 140, the actuator arm end portions 158 of the lever 140 then move in the direction as indicated by the arrows in FIGS. 5B and 5C to forcefully shift or swing the body member 102 of the spring contact element 100, about its bearing point 162 on rest stop surface 94, into and beyond the intermediate position thereof shown in FIG. 5B wherein the force applied to the body member 102 by the actuator lever arm portion 158 more or less coincides with the overcenter or snap-over line L of the spring contact element 100 and the latter, therefore, still remains in its stable position with the base end portion 108 thereof in pressure contact with rest stop surface 94. However, as soon as the pivoting actuator lever 140 shifts or swings the body member 102 about its bearing point 162 on rest stop surface 94 to a position just beyond the over-center or snap-over line L of the spring contact element 100, the tensioned spring-loaded plate spring member 104 then acts to cause the body member 102 of the spring contact element 100 to instantly snap-over and swing to an unstable position as shown in FIG. 5C with the contact lip end 114 of the body member 102 in pressure contact with the fixed contact 88 of the switch S so as to effect the closure thereof. Continued overtravel pivotal movement of the actuator lever 140 in its switch actuating direction, following the snap-over of the spring contact element 100 to its unstable position shown in FIG. 5C, then acts to longitudinally shift the body member 102 of the spring contact element 100 a slight further distance relative to the fixed contact 88 then in pressure contact with the contact lip end 114 of the body member 102, thus causing the contact lip end 114 to wipe across the engaged fixed contact 88 to thus form a good electrical contact therebetween as well as prevent contact welding. The longitudinal shifting of the body member 102 at this time by the actuator lever 140 is permitted by the flexibility of the plate spring member 104 and bracket arm portion 84. On subsequent disengagement of the cam 52 from the actuator lever 140 such as to remove the actuating force therefrom and thus free the lever for return pivotal movement to its original unactuated position, the tensioned plate spring member 104 then acts to instantly snap-over and shift the body member 102 of the spring contact element 100 back to the stable rest position thereof shown in FIG. 5A with the base end portion 108 of the body member 102 of spring contact element 100 bearing against the rest stop surface 94. This snap-action disengagement of the spring contact element 100 from the fixed contact 88, on the return of this element to its stable rest position, thus is particularly helpful in switching inductive loads by means of switch S.

In the modified form of snap action switch S′ comprising the invention shown in FIGS. 8–11, in which essentially corresponding elements to those shown in FIGS. 1–7 are denoted by corresponding primed reference numbers, the principal difference over the switch S shown in FIGS. 1–7 resides in the manner in which the spring contact element 100' is mounted in place on the bracket arm terminal contact 80' and actuator lever 140' and the form of spring loading of the plate spring member 172 of the spring contact element 100'. Thus, in the modified switch S', the mounting of the spring contact element 100' on the bracket arm terminal 30' and actuator lever 140' is reversed, with the body member 170 of the spring contact element 100' pivotally engaged and supported instead at one end by the bracket arm terminal 80' and with the plate spring member 172 supported by the actuator lever 140' and held in a longitudinally compressed bowed spring-loaded condition instead of in a longitudinally tensioned spring-loaded condition as in FIGS. 1–7.

Figure 11:
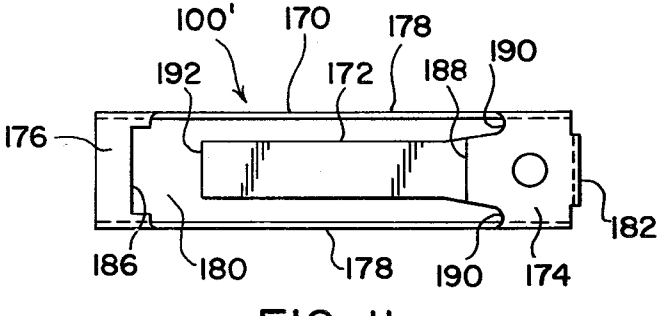
Figure 10:
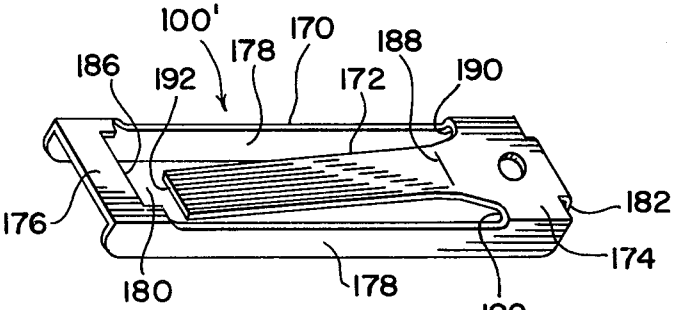
FIG. 10 is a perspective view of the spring contact element of the modified switch shown in FIG. 8; and, FIG. 11 is a plan view of the spring contact element shown in FIG. 10.

Referring more particularly to FIGS. 10 and 11, the spring contact element 100' of the modified switch S', like the spring contact element 100 of switch S, is formed as a stamping from a resilient metal strip material of suitable composition such as, for example, a beryllium-copper alloy or a phosphor bronze alloy, and having a strip thickness around 0.006 inch, for example. The spring contact member 100' is comprised principally of an elongated, rectangular-shaped body member or portion 170 and an elongated cantilever plate spring member or portion 172 extending centrally of the body member. At its opposite ends, the body member 170 is formed with a flat base end portion 174 and a flat pivot end portion 176 connected by a pair of elongated parallel side leg or flange portions 178 which are bent at approximately right angles to the plane of the flat end portions 174, 176 to rigidify the body member against flexure normal to such plane. The flat end portions 174, 176 and their connecting side legs or flanges 178 thus define a rectangular-shaped elongated opening 180 therebetween within which the plate spring member 172 extends centrally thereof. At its outward edge, the flat base end portion 174 is provided with a rest stop lug or tongue portion 182 bent at approximately right angles to the plane of the flat base end portion 174 and in the same direction therefrom as the side leg portions 178 and extending transversely across body member 170. In the normal rest or stable position of the spring contact element 100' in the switch S', the stop lug 182 is adapted to abut endwise against the lever arm 146' of the actuator lever 140' which serves as a rest stop for the spring contact element 100', similar to the rest stop 94 in FIGS. 2–5A, B and C, when the element 100' is in its stable rest position. The flat base end portion 174 of body member 170 is provided with a switch contact 184 which forms the movable contact of the switch and is adapted to be moved into pressure contact with the fixed contact stop surface 88' of the switch, on actuation thereof, to thereby close the switch. The flat pivot end portion 176 of the body member 170 of spring contact element 100' is formed with a straight inward edge 186 extending transversely of the body member to serve as a pivot bearing for the body member 170 of the spring contact element.

The plate spring member 172 of the spring contact element 100' extends longitudinally thereof from the flat base end portion 174 of body member 170 between the side legs 178 and, as fabricated for assembly with the other components of the switch S', it is bent at a slight angle of around 10° or so to the plane of the flat end portions 174, 176 of the body member 170 and to the same side of these portions 174, 176 as the side leg portions 178 are bent therefrom. The bend in the plate spring member 172 is made along a straight bend line 188 extending transversely of the elongated spring contact element 100' and located a short distance inwardly of the element from the concavely rounded inward edges 190 of the base end portion 174 which extend between the plate spring member and the side leg portions 178 of the body member 170. At its free end, the plate spring member 172 is formed with a straight end edge 192 which extends transversely of the body member 170 and parallel to the inward bearing edge 186 of the flat pivot end portion 176 of the body member to serve as a pivot bearing for the plate spring member. The free end edge 192 of the plate spring member is spaced a short distance inwardly from the pivot bearing inward edge 186 of the flat pivot end portion 176 of the body member 170 in order to freely accommodate therebetween an actuating lever arm end portion 194 pivotally engaged with the free end bearing edge 192 of the plate spring member.

The elongated spring contact element 100', like the corresponding element 100 in FIGS. 2–7, is mounted within the chamber 74' of switch housing 60' in a position extending generally longitudinally thereof, but with the flat pivot end portion 176 of body member 170 pivoted and supported at its pivot bearing edge 186 on the bracket arm terminal 80' for pivotal movement of the element 100' in a plane normal to the plane of its flat end portions 174, 176 and which includes the stop surface 88', and with the element 100' extending from the support bracket 80' in a direction toward the stop surface 88', with the contact-carrying flat base end portion 174 of the element 100' disposed flatwise between the stop surface 88' and lever arm 146' and with its contact 184 facing toward the fixed contact stop surface 88'. The arm portion 84' of bracket arm terminal 80' extends through the rectangular opening 180 in the body member 170 of the spring contact element 100', with the inward bearing edge 186 of the body member caught behind the bracket arm portion 84' and held in trunnion bearing notch 130' formed therein.

The spring contact element 100' is actuated and also held in the aforementioned pivotally mounted position in the switch S', with the pivot bearing edge 186 of body member 170 held in continuous bearing engagement within the trunnion bearing notch 130' of bracket arm terminal 80', by the elongated actuator lever 140' which extends longitudinally within the switch housing 60' and is pivoted intermediate its ends on pivot shaft 142' for pivotal movement about axis b' normal to the plane of pivotal movement of spring contact element 100' on bracket arm terminal 80'. Actuator lever 140', like the actuator lever 140 in FIGS. 2–7, is also comprised of a cam engaging lever arm 144' and a spring contact engaging lever arm 146' which extend in opposite directions lengthwise of housing 60' from the pivot shaft 142'. Lever arm 144' is formed at its free end with a rounded hook-shaped cam follower projection 148'. Lever arm 146' is transversely offset relative to lever arm 144' so as to extend alongside the spring contact element 100' in a position laterally thereof between the side leg portions 178 of the element and to that side of the flat base end portion 174 opposite the side thereof provided with the switch contact 184. The transverse actuator arm end portion 194 of lever arm 146' extends through the rectangular opening 180 in the body member 170 of spring contact element 100′ at a location between the spaced pivot bearing edges 186 and 192 thereof, and it is provided with a laterally extending V-shaped bearing notch or groove 160′ which receives and pivotally supports therein the free end bearing edge 192 of the plate spring member 172. The actuator arm end portion 194 of actuator lever 140′ forcibly presses against the free end bearing edge 192 of the plate spring member 172 to exert a longitudinal compression force thereon effective to compress and hold the plate spring member in a longitudinally bowed spring-loaded condition which thus acts to continuously hold the spring contact element in its mounted position on the bracket arm terminal 80′ and actuator lever 140′.

For the spring contact element 100′ of the modified switch S′ to properly operate in its intended switching manner, it must be mounted on the bracket arm terminal 80′ and actuator lever 140′ in a position as shown such that the bowed, compressed plate spring member 172 bows or curves away from the flat base end portion 174 of the body member 170 in a direction toward the lever arm 146′ of the actuator lever 140′. Also, in the normal assembled position of the spring contact element 100′ in the switch S′, as shown in FIG. 9A, the arm end portion 194 of actuator lever 140′ presses against the end edge 192 of the plate spring member 172 to exert a force endwise thereagainst passing to the same side as switch contact 184 from the straight over-center or snap-over line L′ which extends through and between the pivot axis of the body member 170 on bracket arm terminal 80′ and the bearing point 162′ of the rest stop lug 182 of body member 170 against the lever arm 146′ of actuator lever 140′ when the spring contact element 100′ is in its normal rest or stable position shown in FIG. 9A. This force exerted by the actuator lever 140′ against the plate spring member 172 thus acts to hold and maintain the spring contact element in its normal rest or stable position as described above and shown in FIG. 9A.

Figure 9B:
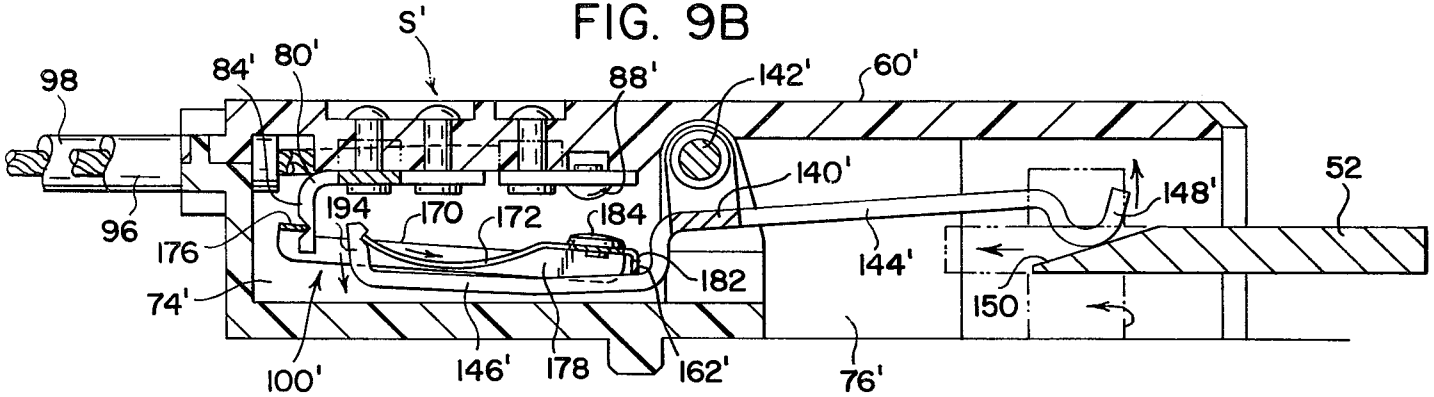
FIGS. 9A, 9B and 9C are views similar to FIGS. 5A, 5B and 5C, respectively, but showing instead the modified form of snap action switch of FIG. 8.
Figure 9A:
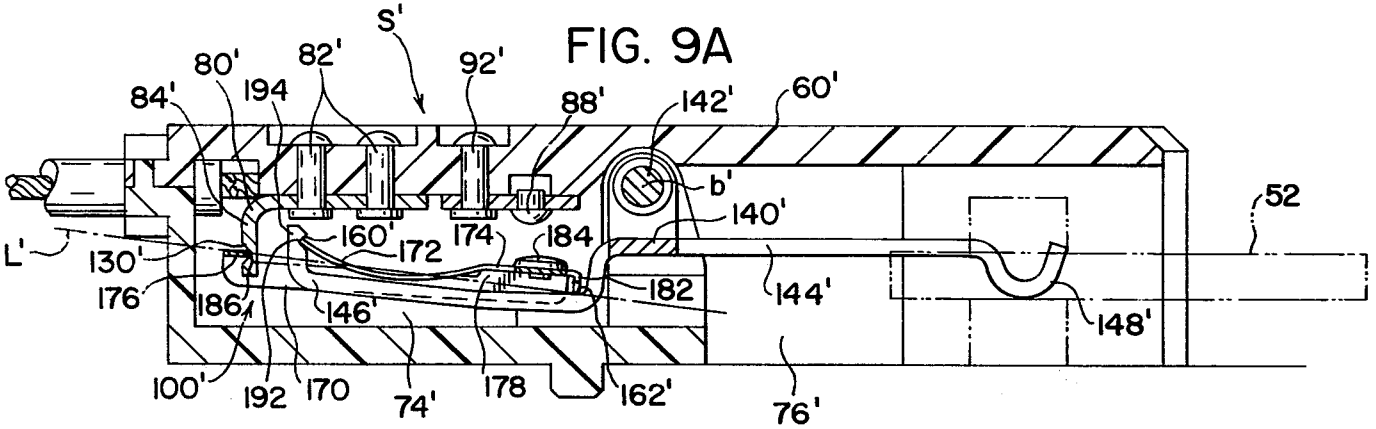

When the actuator lever 140′ is pivoted by the engagement of the tapered cam surface 150 of cam 52 with the cam follower projection 148′ on lever 140′, the actuator arm end portion 194 of the lever 140′ then moves in the direction as indicated by the arrow in FIG. 9B to forcefully shift or swing the compressed, bowed plate spring member 172 of the spring element contact 100′ about its anchored end on the base end portion 174 of body member 170, into and beyond the intermediate position thereof shown in FIG. 9B wherein the force applied to the plate spring member 172 by the actuator lever arm end portion 194 more or less coincides with the over-center or snap-over line L′ of the spring contact element 100′ and the latter still remains in its stable position with the rest stop lug 182 of its base end portion 174 in pressure contact with actuator lever arm 146′ which serves as a rest stop surface.

Figure 9C:
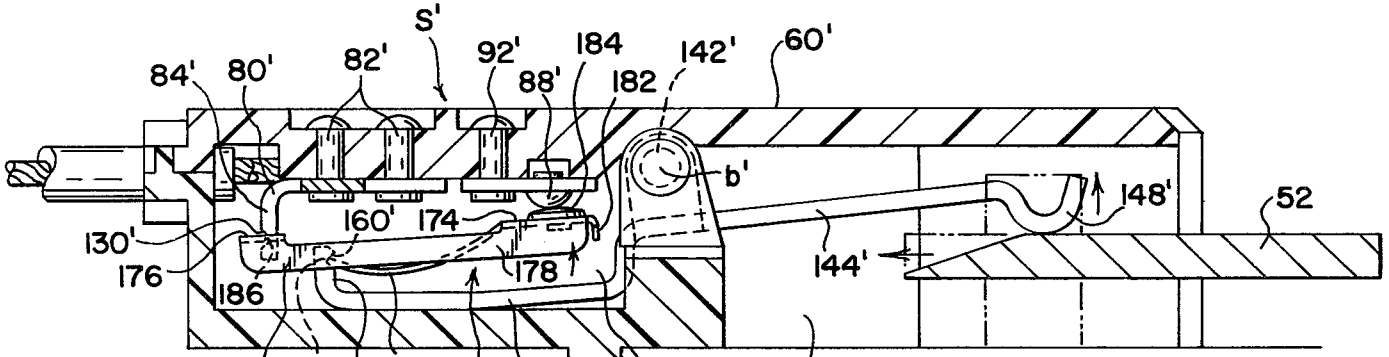

However, as soon as the pivoting actuating lever 140′ shifts or swings the plate spring member 172 about its anchored end on the base end portion 174 to a position where the compressive force exerted by the actuating lever 140′ against the free end 192 of the compressed and bowed plate spring member 172 is applied thereto at a position just beyond the over-center or snap-over line L′ of the spring contact element 100′, the compressed spring-loaded plate spring member 172 then acts to cause the body member 170 of the spring contact element 100′ to instantly snap-over and swing to an unstable position as shown in FIG. 9C with the switch contact 184 of the body member in pressure contact with the fixed contact 88′ of the switch S′ so as to effect the closure thereof.

As with the previously described form of switch S shown in FIGS. 1–7, on subsequent disengagement of the cam 52 from the actuator lever 140′ of switch S′ such as to remove the actuating force therefrom and thus free the lever for return pivotal movement to its original unactuated position, the compressed plate spring member 172 acts to instantly snap-over and toggle the body member 170 of the spring contact element 100′ back to the stable rest position thereof shown in FIG. 9A with the rest stop lug 182 of the body member bearing against the lever arm 146′ of actuator lever 140′. This snap action disengagement of the spring contact element 100′ and its switch contact 184 from the fixed contact 88′ thus is helpful in switching inductive loads by means of switch S′.

While the plate spring members 104 and 172 of the snap switch constructions S and S′ are shown and described herein as being integrated with the body members 102 and 170 of the respective spring contact elements 100 and 100′, they may be formed instead separately from the body members and suitably hinged thereto.

It will be evident that, with switch constructions S and S′ as shown and described above, a snap action switch is provided which is easily actuated by operating means moving parallel to the main switch body such as is required in certain snap switch applications. Also, with snap action switches S and S′ according to the invention, the stress to which the plate spring members 104 and 172 thereof are subjected during switch usage is distributed more uniformly along their lengths as compared to most prior snap action switch constructions. As a result, the possibility of stress-induced cracking of the plate spring members of the switches S and S′, due to the notch-sensitive character of the beryllium-copper alloys customarily employed for the spring members of snap action switches, is greatly minimized. Also, due to their particular operating characteristics, snap action switches constructed in accordance with the invention possess the capability of providing relatively large switch point hysteresis which is of particular advantage in many switch applications.

Once the spring contact element 100 or 100′ of the switch constructions S and S′ has been snapped over to its unstable or closed switch position by movement of the cam operating means 52, any further movement of the switch actuating lever 140 or 140′ in the switch actuating direction by the cam means 52 merely results in additional resilient deformation of the plate spring members 104 or 172 of these switches without causing any effect on the condition of the switch, i.e., the switch contacts 88, 114 or 88′, 184 will remain in their pressure contact engagement with one another. Thus, the spring contact elements 100 or 100′ of the switches S and S′ in this way can accommodate a large amount of overtravel movement of the switch operating means without suffering damage and loss of its operating characteristics or stress failure of the spring member thereof.

In the modified switch construction S′ shown in FIGS. 8–11, it will be evident that the stressed plate spring member 100′ thereof does not carry any electrical current directly therethrough in the closed switch position wherein the spring contact element is in its unstable position with the switch contact 184 thereon in pressure contact with the fixed contact 88′ of the switch. Instead, the electrical current passes directly through the body member 170 of the spring contact element 100'. As a result, the stressed plate spring member 172 is not subjected to any resistive heating, by the electrical current passing through the closed switch, such as could shorten the life of the switch, particularly in high current applications.

The invention has been described with reference to preferred embodiments thereof. Obviously, modifications and alterations will occur to others upon the reading and understanding of this specification. Thus, as an example, instead of the switch S operating to close an electrical circuit only when the spring contact element 100 is shifted to its unstable position with switch contact 114 in pressure contact with the fixed contact 88, the switch S may be arranged to also close a second electrical circuit when the spring contact element 100 is shifted to its normal rest or stable position. For such purpose, it is merely necessary to provide a second fixed contact for the switch in place of the rest stop surface 94 thereof and to also provide the spring contact element 100 with a suitable second switch contact on the opposite side thereof from switch contact 114 for engaging with the second fixed contact when the spring contact element is shifted to its normal rest or stable position. It is my intention, therefore, to include such modification and any other alterations insofar as they come within the scope of the appended claims or the equivalents thereof.

Having thus described the invention, it is claimed:

1. A snap action switch comprising an elongated housing having spaced opposed side walls, spaced opposed top and bottom walls, a transversely extending end wall at one end of the housing, and an intermediate transversely extending bridge wall, said walls together defining a switch chamber portion, a pair of opposed spaced stop surfaces in said switch chamber including at least one fixed contact, an elongated spring contact element of resilient metal strip material mounted in said switch chamber and including an elongated body member and an elongated plate spring member, said body member being rigidified against flexure and comprised of a pair of laterally spaced parallel legs having opposite ends, said legs being integral with and connected at one of their said ends by a flat base end portion of said body member, said plate spring member being connected at one end with said base end portion and extending flatwise therefrom in a direction generally lengthwise of said legs and at a location therebetween and terminating in a free other end, and mounting means supporting said spring contact element in said switch chamber for pivotal movement in a plane including said stop surfaces, said mounting means comprising both a bracket arm terminal contact in said switch chamber and an elongated actuator lever located in said housing and pivotally mounted intermediate its ends and exteriorly of said switch chamber on a pivot pin in said housing for pivotal movement in said plane, said lever extending into the said switch chamber portion of the housing from said pivot pin in a direction generally lengthwise of said switch contact element, said bracket arm terminal contact and actuator lever pivotally engaging respective ones of said members at the other ends thereof opposite their said one ends connected to said flat base end portion and longitudinally spring loading said plate spring member in a longitudinally bowed shape effective to hold said members in said pivotally engaged relation with said bracket arm terminal contact and said actuator lever, with the spring contact element normally held by said plate spring member in a stable rest position with the said base end portion thereof in pressure contact with one of said stop surfaces, said plate spring member acting to cause said spring contact element to snap over to an unstable position with the said base end portion thereof in pressure contact with the other one of said stop surfaces on application of an actuating force to said actuator lever in a direction to move the respective one of said members engaged therewith to an over-center position relative to the other one of said members.

2. A snap action switch as defined in claim 1 wherein the said plate spring member is operative to automatically move the said spring contact element back to its said stable rest position on removal of the said actuating force applied to said actuator lever.

3. A snap action switch as defined in claim 1 wherein the said bracket arm terminal and actuator lever are respectively pivotally engaged with said bowed plate spring member and said body member and hold the said spring member in a tensioned spring loaded condition.

4. A snap action switch as defined in claim 3 wherein the said actuator lever extends generally longitudinally of said elongated spring contact element and is pivoted intermediate its ends for pivotal movement about a pivot axis normal to the said plane of pivotal movement of said spring contact element, said actuator lever being bifurcated at one end to provide a laterally spaced pair of actuator arm end portions engaged with the said other ends of the said legs of said spring contact element, and the said plate spring member extending between the said spaced actuator arm end portions and into the said pivotally engaged relation with said bracket arm terminal.

5. A snap action switch as defined in claim 4 wherein the said bracket arm terminal is bifurcated to provide a pair of laterally spaced fingers and the said tension spring-loaded bowed plate spring member is integral with the said base end portion of said body member and extends between the said spaced fingers and is provided at its free end with laterally outward projecting ears caught behind the said fingers and held within trunnion bearing notches therein by the said tensioned plate spring member.

6. A snap-action switch as defined in claim 3 wherein the said bracket arm terminal is bifurcated to provide a pair of laterally spaced fingers and the said tension spring-loaded bowed plate spring member is integral with the said base end portion of said body member and extends beween the said spaced fingers and is provided at its free end with laterally outward projecting ears caught behind the said fingers and held within trunnion bearing notches therein by the said tensioned plate spring member.

7. A snap action switch as defined in claim 1 wherein the said plate spring member is integral with the said base end portion of said body member.

8. A snap action switch as defined in claim 1 wherein the said other one of said stop surfaces is a fixed contact and the said bracket arm terminal is flexurable a slight degree toward said stop surfaces, and said actuator lever is movable a fursther distance, following the said snap-over of the spring contact element to the said unstable position, to thereby longitudinally shift said element a short distance relative to and toward the said fixed contact so as to cause the said base end portion of the spring contact element in contact with said fixed contact to wipe thereacross.

9. A snap action switch as defined in claim 1 wherein the said actuating means comprises an elongated actuator lever extending generally longitudinally of said elongated spring contact element and pivoted intermediate its ends on said pivot pin for pivotal movement about a pivot axis normal to the plane of pivotal movement of said spring contact element.

10. A snap action switch as defined in claim 9 wherein the said pivot axis of said elongated actuator lever is located at a position endwise beyond the said base end portion of said spring contact member, and the said actuator lever includes lever arms extending longitudinally in opposite directions relative to said pivot axis, one of said lever arms extending abreast of said spring contact element and being provided with an actuator arm end portion engaged with said spring contact element, and the other one of said lever arms being provided adjacent its outer end with cam follower means for engagement by a cam means moving in a direction longitudinally of said actuator lever to pivotally actuate the latter.

11. A snap action switch as defined in claim 1 wherein the said bracket arm terminal and actuator lever are respectively pivotally engaged with said body member and said plate spring member and hold the said plate spring member in a compressed longitudinally bowed spring loaded condition.

12. A snap action switch as defined in claim 11, wherein the said actuator lever extends generally longitudinally of said elongated spring contact element and is pivoted intermediate its ends for pivotal movement about an axis normal to the said plane of pivotal movement of said spring contact element, said actuator lever including lever arms extending longitudinally in opposite directions relative to said pivot axis, one of said lever arms extending abreast of said spring contact element and being provided with an actuator arm end portion extending transversely of said one lever arm and between the said spaced legs of said spring contact element and into the said pivotally engaged relation with said plate spring member.

13. A snap action switch as defined in claim 11 wherein the said bracket arm terminal extends between the said spaced legs of said spring contact element, and the said spaced legs are connected at their ends opposite the ends thereof connected to said base end portion of the spring contact element by a transversely extending flat end plate portion integral with the said spaced legs and caught behind the said bracket arm terminal and held within bearing notches therein by the said compressed plate spring member.

14. A snap action switch as defined in claim 12 wherein the said bracket arm terminal also extends between the said spaced legs of said spring contact element, and the said spaced legs are connected at their ends opposite the ends thereof connected to said base end portion of the spring contact element by a transversely extending flat end plate portion integral with the said spaced legs and caught behind the bracket arm terminal and held within bearing notches therein by the said compressed plate spring member.

15. A snap action switch comprising an elongated housing, a pair of opposed spaced stop surfaces in said housing including at least one fixed contact, an elongated spring contact element of resilient metal strip material mounted in said housing and including an elongated body member and an elongated plate spring member, said body member being rigidified against flexure and comprised of a pair of laterally spaced parallel legs having opposite ends, said legs being integral with and connected at one of their said ends by a flat base end portion, said plate spring member being connected at one end with said base end portion and extending flatwise therefrom in a direction generally lengthwise of said legs and at a location therebetween and terminating in a free other end, and mounting means supporting said spring contact element in said housing for pivotal movement in a plane including said stop surfaces, said mounting means comprising both a bracket arm terminal contact in said housing and an elongated actuator lever in said housing extending generally longitudinally of said elongated spring contact element and pivoted intermediate its ends on a pivot pin in said housing for pivotal movement about a pivot axis normal to the said plane of pivotal movement of said spring contact element, said bracket arm terminal contact and said actuator lever pivotally engaging respective ones of said members at the other ends thereof opposite their said one ends connected to said flat base end portion and longitudinally spring loading said plate spring member in a longitudinally bowed shape effective to hold said members in said pivotally engaged relation with said bracket arm terminal contact and actuator lever, with the spring contact element normally held by said plate spring member in a stable rest position with the said base end portion thereof in pressure contact with one of said stop surfaces, said plate spring member acting to cause said spring contact element to snap over to an unstable position with the said base end portion thereof in pressure contact with the other one of said stop surfaces on application of an actuation force to said actuator lever in a direction to move the respective one of said members engaged therewith to an over-center position relative to the other one of said members, and said fixed contact one of said stop surfaces and said bracket arm terminal both being fixedly secured to the wall of said housing and said actuator lever extending longitudinally of said housing and being pivotally mounted thereon.

16. A snap action switch as defined in claim 15 wherein that one of said stop surfaces opposite the said fixed contact stop surface comprises a flat rest surface on the wall of said housing.

17. A snap action switch comprising a housing having spaced opposed side walls, spaced opposed top and bottom walls, a transversely extending end wall at one end of the housing, and an intermediate transversely extending bridge wall between said side walls, said bridge wall dividing the housing into a switch chamber and a cam-receiving chamber, said cam-receiving chamber being open at the other end of the housing and throughout at least a portion of one of the housing sides extending from the said open other end of the housing to thereby permit entry of a switch operating cam into the said cam-receiving chamber, a snap switch mounted in said switch chamber and including an elongated switch contact element extending longitudinally of the housing and comprising an elongated rigid switch blade body member and an elongated plate spring member, and an elongated switch actuator lever in said housing extending generally longitudinally thereof and pivotally mounted intermediate its ends and exteriorly of said switch chamber on a pivot support in said housing, said actuator lever having elongated lever arm portions extending in opposite directions from said pivot support, one of said lever arm portions extending into said switch chamber and engaged with one of the said members of said switch contact element to actuate the switch on pivotal movement of the lever in a switch actuating direction, and the other one of said lever arm portions extending through the said cam-receiving chamber and provided with cam follower means for engagement with said switch operating cam to effect the said pivotal movement of the lever in said switch actuating direction.

18. A snap action switch as defined in claim 17, wherein the said one lever arm portion of the actuator lever is engaged with the said body member of the spring contact element.

19. A snap action switch as defined in claim 17, wherein the said one lever arm portion of the actuator lever is engaged with the said plate spring member of the spring contact element.

* * * * *